US005110510A

United States Patent [19]

Norcross

[11] Patent Number: 5,110,510

[45] Date of Patent: May 5, 1992

[54] AERATION AND MIXING APPARATUS

[75] Inventor: Kenneth L. Norcross, Kansas City, Mo.

[73] Assignee: JMO Holding, Inc., Industrial Airport, Kans.

[21] Appl. No.: 658,997

[22] Filed: Feb. 21, 1991

[51] Int. Cl.[5] ..... B01F 3/04

[52] U.S. Cl. ..... 261/91; 210/242.2; 261/120

[58] Field of Search ..... 210/242.2; 261/91, 120

[56] References Cited

U.S. PATENT DOCUMENTS

| | | | |
|---|---|---|---|
| 3,846,516 | 11/1974 | Carlson | 261/120 |
| 3,865,909 | 2/1975 | Cramer | 261/120 |
| 4,089,620 | 5/1978 | Ravitts | 261/91 |
| 4,350,648 | 9/1982 | Watkins, III et al. | 261/120 |
| 5,021,154 | 6/1991 | Haegeman | 210/242.2 |

FOREIGN PATENT DOCUMENTS

| | | | |
|---|---|---|---|
| 58-11029 | 1/1983 | Japan | 261/91 |

*Primary Examiner*—Tim Miles

*Attorney, Agent, or Firm*—Litman, McMahon & Brown

[57] ABSTRACT

An aeration and mixing apparatus for use in a wastewater treatment facility is mounted on a float and includes an axial-flow mixer having a stem that extends through a flow channel in the float, a diffuser cone slidingly mounted on the mixer stem and a diffuser hood fixedly attached to the diffuser cone and located below the float. A diffuser-drive mechanism mounted on the float transfers the diffuser cone and attached diffuser hood between a first, aeration position and a second, anoxic-mixing position. In the first position, the cone is spaced above the channel of the float and the diffuser hood abuts a bottom surface of the float with wastewater being propelled by the mixer upwardly through the hood and flow channel onto the diffuser cone where it is dispersed outwardly in the air above the float. In the second position, the cone is seated on the float in the channel, blocking flow of fluid through the flow channel, and the diffuser hood is spaced from the bottom of the float with the mixer propelling water downwardly through the hood.

7 Claims, 1 Drawing Sheet

AERATION AND MIXING APPARATUS

BACKGROUND OF THE INVENTION

The present invention relates generally to floating surface aerators for mixing oxygen with treated wastewater in a wastewater treatment facility and, in particular, to such an aerator that is also an anoxic mixing device.

In a sequencing batch reactor (SBR) for treating wastewater with activated sludge, wastewater, during a fill period of an SBR treatment cycle, is introduced into the reactor having a layer of sludge therein. This "fill" period is primarily anoxic or without aeration and a mixer may be utilized to stir and intermix the sludge and incoming liquid. Aeration of the mixture is then initiated. Aeration is necessary because the microorganisms in the sludge require oxygen to sustain their metabolic function, allowing them to grow and multiply so as to rapidly consume organic material in the waste that the bacteria feed upon. When aeration is discontinued, the mixed liquor is allowed to settle under quiescent conditions so as to separate sludge from clarified fluid. A portion of the clarified liquid with contaminants substantially removed is then decanted.

It is important that during the anoxic fill and mixing period, the liquid is not aerated so that there is a wide swing in the food-to-microorganism (F/M) ratio and the oxygen uptake rate of the wastewater and sludge between this fill and/or mixing period and the aeration period as the bacteria require oxygen in order to consume the waste. During the anoxic fill and mixing period, the F/M ratio is high, setting the stage for a "feast" when aeration of the basin begins. During the "feast" period of aeration, the dissolved oxygen level stays near zero because the oxygen demand exceeds the aeration system's maximum capacity. This is beneficial because the growth of unwanted, slow-growing filaments is inhibited and the growth of beneficial, floc-forming, zoogleal organisms is encouraged.

Typically, an SBR contains an anoxic mixing device and a separate aeration device. As indicated in the previous paragraph, this separation is important so that the mixing device does not promote aeration. It would be economically advantageous, however, to have one device that can both selectively anoxically mix and later aerate the liquid in a wastewater reactor. It is noted that it is also possible to use alternating aeration and mixing in certain operational modes to encourage removal of nitrogen or for other operational considerations which may be accomplished by such a single device.

SUMMARY OF THE INVENTION

The present invention is an aeration and mixing apparatus that includes a mixer and diffuser, both mounted on a foam-filled float. A mixer drive motor is mounted on the top of the float and operates an axial-flow mixer having a mixing stem that extends downwardly through a generally vertical flow tunnel in the float and into a diffuser hood that is located below the base of the float. A pair of radiating blades are fixedly attached to the base of the mixing stem and are positioned centrally within the diffuser hood so as to provide a fluid flow generating propeller when rotated. A diffuser cone is slidingly mounted on the mixer drive shaft below the drive motor and is fixedly attached in spaced relation to the diffuser hood.

When the apparatus is utilized as an aerator, the diffuser cone is located in a raised position directly beneath the support frame plate upon which the mixer drive motor is mounted and held in place by a diffuser drive and support mechanism that is fixedly attached to the top of the support frame plate and operably connected to the cone. When in the raised position, the diffuser cone is spaced from the tunnel and allows flow therethrough. The diffuser drive mechanism may be operated pneumatically, hydraulically, electrically or the like. When the diffuser cone is located adjacent to the base of the support frame plate, the attached diffuser hood is also raised and adjacent to the base of the float. In this raised configuration, when the mixer shaft rotates to urge upward liquid flow, liquid is propelled up through the diffuser hood by the blades of the mixer and forced upwardly into the flow tunnel of the float so as to impinge onto the diffuser cone where the liquid is forced outwardly, dispersing it through the air above the float.

When the apparatus is utilized as an anoxic mixer, the diffuser drive is engaged and the diffuser cone is urged to a lowered position wherein an outer flange of the cone is seated against an upper surface of the float, sealing off fluid flow through the flow tunnel. The diffuser hood that is attached to the diffuser cone is also moved in a downward direction to a lowered position, creating a space between the float and the diffuser hood. The mixer drive motor is engaged with the rotation of the radiating blades being reversed, thereby drawing liquid into the top of the diffuser hood propelling the drawn liquid in a downward direction out the bottom of the diffuser hood so as to mix such liquid with a degree of agitation with the remaining liquid in the reactor.

OBJECTS AND ADVANTAGES OF THE INVENTION

Therefore, the objects of the present invention are: to provide an improved apparatus that alternatively functions as an anoxic mixer or as an aerator; to provide such an apparatus for use in conjunction with a wastewater treatment facility; to provide such an apparatus which is articulated with respect to the reactor basin and freely moves vertically to compensate for change in the liquid level within the basin; to provide such an apparatus that is buoyantly mounted on a float at the surface of a liquid-filled reactor basin; to provide such an apparatus that includes a diffuser cone and cooperating diffuser hood that are slidingly mounted on the float; to provide such an apparatus wherein the diffuser cone is located above the liquid surface and the diffuser hood is located below the liquid surface; to provide such an apparatus wherein the diffuser cone has a first position wherein the diffuser cone prevents liquid from flowing through a channel in the float and a second position Wherein same is spaced from the channel to allow flow of fluid through the channel and dispersion by the cone; to provide such an apparatus wherein the diffuser hood is movable between a first position wherein same directly flows into the channel passing through the float and a second position wherein the diffuser hood is spaced from the float; to provide such an apparatus that is relatively easy to use, inexpensive to construct, easy to install, has a relatively long life expectancy and is particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
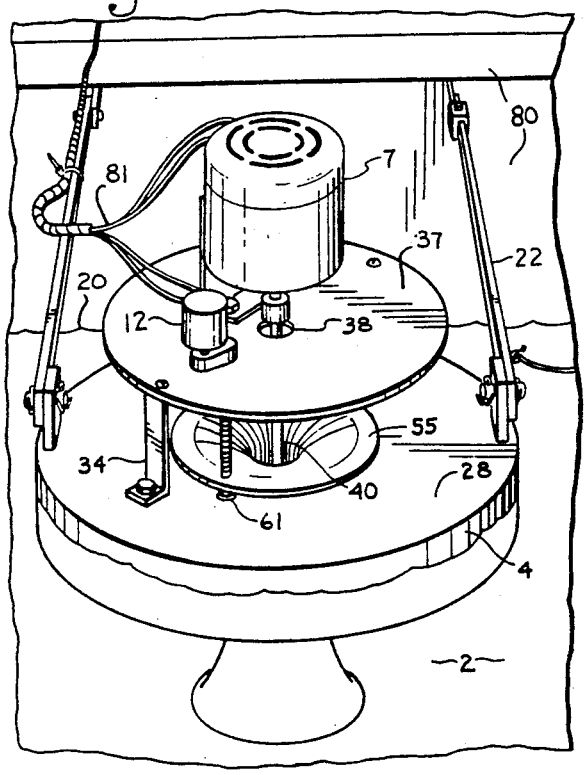
FIG. 1 is perspective view of an aeration and mixing apparatus according to the present invention.
Figure 2:
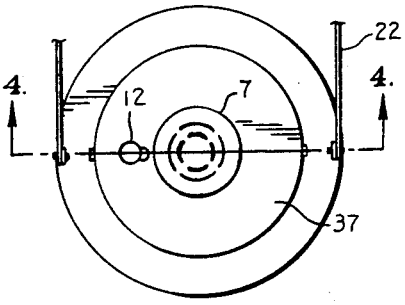
FIG. 2 is a top plan view of the apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an aeration and mixing apparatus of the present invention adapted for the passage of liquid 2 therethrough and including a float 4, a mixer drive motor 7, an axial-flow mixer, generally designated by the reference numeral 9, a diffuser drive mechanism 12, a diffuser member or cone 15 and a diffuser hood 18. The apparatus 1 is utilized in the reservoir or body of liquid 2, with the float 4 buoyantly supporting the other components of the apparatus and maintaining the mixer drive motor 7, the diffuser drive mechanism 12 and the diffuser cone 15 above a surface 20 of the liquid 2.

The float 4 is generally cylindrical in shape and has an axially-located bore, flow tunnel or channel 21. The float 4 is secured in a fixed position in the liquid 2 by mooring arms 22, cables, or the like. It is foreseen that the float 4 could be made in other configurations. The float 4 includes an outer shell 23, preferably made from fiberglass or stainless steel, having an outer cylindrical wall 24, an inner cylindrical wall 26, a top surface 28 and a bottom surface 30. The float 4 is filled with foam or other suitable floatable material having a relatively low density within the shell 23.

A plurality of vertical support rods or brackets 34 are welded or otherwise fixedly attached to the top surface 28 of the float 4 and are perpendicular thereto. A generally circular support frame plate 37 is fixedly mounted to the support brackets 34 at the upper ends thereof such that the support frame plate 37 is fixed in a predetermined spaced relationship with respect to the float top surface 28. The support brackets 34 are perpendicular to the plate 37 With the brackets located near the outer periphery thereof. The support plate 37 has a diameter greater than the diameter of the inner cylindrical wall 26 of the float 4 and is located centrally above the vertically and axially aligned flow channel 21.

Figure 4:
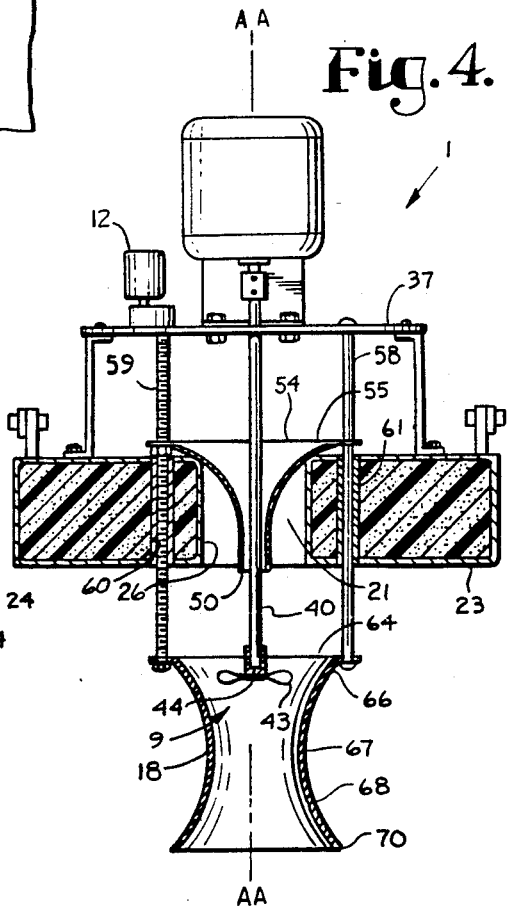
FIG. 4 is a cross-sectional view of the apparatus shown in a lowered, mixing position.

The mixer drive motor 7 is fixedly mounted on the top of the support frame plate 37 and a rotatable mixing stem 40, that is operably connected to the motor 7, extends therefrom and through an aperture 38 in the support frame plate 37, along a generally vertical axis A-A (as is shown in FIG. 4) of the flow channel 21 and downwardly therefrom. The mixer drive 7 is selectively operable by an operator to rotate the mixing stem 40 in either a clockwise or counterclockwise direction. A pair of radiating mixing blades 43 are fixedly attached to a distal end 44 of the mixing stem 40 and are spaced from the bottom surface 30 of the float 4. The blades 43 are configured such that when the mixing stem 40 is rotating in one direction, the blades 43 propel the liquid 2 in an upward direction. When the rotation of the mixing stem 40 is reversed, the blades 43 generally propel the liquid 2 in a downward direction.

The diffuser drive mechanism 12 is also fixedly mounted to the top of the support frame plate 37. The diffuser drive 12 is operably connected to the diffuser cone 15 that is positionable in raised and lowered positions slidingly mounted on the mixing stem 40, and both are located generally between the support frame plate 37 and above the bottom surface 30 of the float 4. The diffuser cone 15 has a pointed end 50 that points downwardly toward the mixing blades 43, and an upwardly and outwardly flaring, cone-shaped side wall 52 having an upper flange 54 with a generally horizontal top edge 55. The mixing stem 40 passes through the pointed end 50 and is freely rotatable therewithin.

A plurality of generally vertically-oriented connecting rods 58 pass through to the upper flange 54 of the diffuser cone 15 and extend vertically through bores 60 in the float 4 that are sleeved by bushings 61. One of the rods 58 is a controlling rod 59 and is fixedly attached to the upper flange 54 of the diffuser cone 15, with the remainder of the rods 58 being slidingly received therein. The rod 59 has an upper portion that is threaded and operably driven by a motor and screw set of the drive mechanism 12 to selectively raise and lower the rod 59 and, consequently, the cone 15 and the hood 18.

The lower end of the rod 59 is fixedly connected to an upper flange 64 of the diffuser hood 18 with the remaining rods 58 being slidably connected to the hood 18. The diffuser hood 18 is a hollow structure having a hyperboloid shape with a flared upper portion 66, a concave or indented mid-section 67, a flared lower portion 68 and a bottom flange 70.

Figure 3:
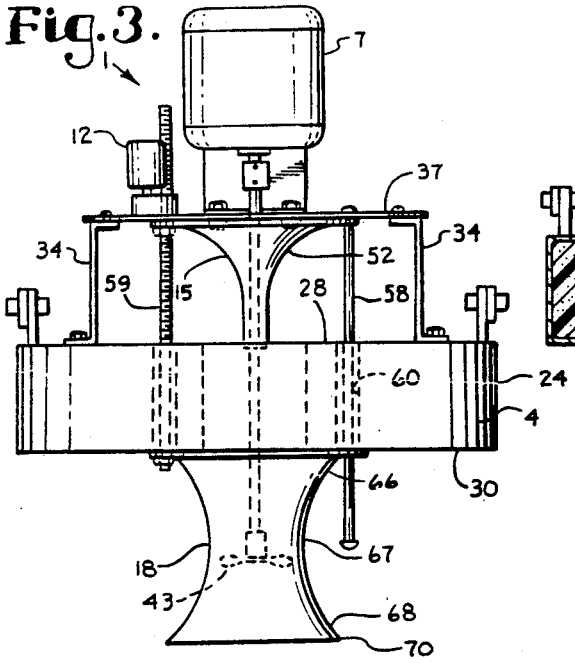
FIG. 3 is a cross-sectional view of the apparatus shown in a raised, aeration position.

Water-propelling means, as illustrated by the mixer 9, in cooperation with the diffuser cone 15 and fixedly-spaced diffuser hood 18, are selectively positionable in a first, raised aeration position or, alternatively, in a second, dropped, anoxic-mixing position relative to the float 4 and specifically with respect to the flow channel 21, which position is controlled by the drive mechanism 12 by movement of the drive rod 59. In the first, raised position, as is shown in FIG. 3, the diffuser drive mechanism 12 holds the cone 15 in an aeration position with the upper edge 55 of the flange 54 of the cone 15 abutting against the lower surface of the support frame plate 37 and with the cone 15 spaced from both the float 4 and the float channel 21.

When the diffuser cone 15 is in the first position, the connecting rods 58 and drive rod 59 maintain the diffuser hood 18 at a position with the upper flange 64 abutting against the bottom surface 30 of the float 4, flow connecting the diffuser hood 18 with the flow tunnel 21 of the float 4 to prevent flow of fluid therebetween. When the diffuser hood 18 is in the first or raised position, the mixing blades 43 are located generally between the narrow mid-section 67 and lower flared portion 68 of the diffuser hood 18.

In the second or lowered position, the diffuser drive mechanism 12 presses the cone 15 downwardly with the end 50 located within the flow channel 21 and the flaring side wall 52 abutting against the wall 26 of the float 4, sealing the top opening to the channel 21 and preventing flow of fluid therethrough.

When the diffuser cone 15 is in the second or lowered position, as is shown in FIG. 4, the connecting rods 58 and drive rod 59 maintain the diffuser hood 18 at a relative location with the upper flange 64 spaced from the bottom surface 30 of the float 4. When the diffuser hood 18 is in the second or lowered position, the mixing blades 43 are located generally between the narrow mid-section 67 and the upper flared portion 66 of the diffuser hood 18.

The diffuser drive mechanism 12 may be operated by an electrical, pneumatic or hydraulic motor or the like. The mechanism 12 operably raises or lowers the drive rod 59, as is required to move the diffuser cone 15 and hood 18 between the first or second positions discussed above, under control of an operator or computer.

In use, the apparatus 1 is placed in a suitable body of liquid 2 and pivotally connected by hinged mooring arms or cables 22 to the walls of a reactor basin 80 holding the liquid 2. It is foreseen that the apparatus 1 may be connected to a decanter mechanism or related structure that is also buoyantly supported by a float and located centrally within the reactor basin 80. The float 4 and hinged mooring cables 22 maintain the apparatus articulated with respect to the reactor basin 80 so as to allow the apparatus 1 to freely move vertically to compensate for any change in the liquid level within the reactor basin 80. A control line 81 for powering the mixer drive motor 7 and the diffuser drive mechanism 12 is also provided.

In operation, when the apparatus 1 is utilized as an anoxic-mixing device while the liquid 2 to be treated is entering or has just completed filling a reactor basin, an operator engages the diffuser drive mechanism 12 and the diffuser cone 15 is slidingly moved to the lowered, mixing position, sealing the flow channel 21. The operator then engages the mixer drive motor 7 and selectively drives the mixing stem 40 and blades 43 in a direction so as to draw liquid 2 near the upper flange 64 of the diffuser hood 18 in a downward direction and out of the bottom flange 70 of the hood 18, thereby mixing the liquid 2 in the wastewater basin 80.

When it is desired that the liquid 2 should be aerated, an operator engages the diffuser drive mechanism 12 and the diffuser cone 5 is slidingly raised to the aeration position, opening the flow channel 21. The rods 58 concurrently slide upwardly within the bushings 61 until the diffuser hood 18 abuts against the float 4. The operator then engages the mixer drive motor 7 and selectively drives the mixing stem 40 and blades 43 in an opposite direction so as to draw liquid 2 near the lower flange 70 of the diffuser hood 18 in an upward flow path therethrough. The blades 43 propel the liquid 2 through the hollow diffuser hood 18, the flow channel 21, so as to impinge on the flaring sidewall 52 of the diffuser cone 15, which forces the liquid 2 in an outward direction, dispersing the liquid 2 through the air above the float 4, thereby aerating the liquid 2 in the wastewater basin 80.

It is to be understood that while certain forms of the present invention have been illustrated and described herein, it is not to be limited to the specific forms or arrangement of parts described and shown.

What is claimed and desired to be secured by Letters Patent is as follows:

1. In a surface aerator for reacting oxygen with treated wastewater in a wastewater treatment facility having a float, a diffuser member and an axial-flow mixer with radially-extending blades for propelling wastewater upwardly through a flow channel in the float and onto the diffuser member; the improvement comprising:

(a) a diffuser cone slidingly mounted with respect to said mixer; and (b) a diffuser hood connected to said cone and in spaced relation thereto; said hood surrounding the blades of the mixer; said cone and said hood being simultaneously slidable between a mixing position with said cone adapted to block flow of wastewater through said channel and said hood spaced below the float and an aeration position wherein said cone is spaced from said channel and said hood has an upper end thereof abutting said float such that said hood and channel combine to form a common wastewater flow pathway therethrough.

2. A aeration and mixing apparatus for treating water in a wastewater treatment facility comprising:

(a) a mounting float having a top, a bottom and a centrally-located, generally vertical bore;

(b) an axial flow mixer mounted on said float; said mixer having a mixing stem and a pair of mixing blades; and mixing stem extending through said bore;

(c) a support plate mounted on said float and spaced upwardly therefrom;

(d) a mixer motor mounted on said support plate and operably connected to said mixer.

(e) a diffuser cone having a top edge, an upper flange, a flaring side wall and a point directed downward; said cone being slidingly mounted on said mixing stem; said diffuser cone being located below said support plate;

(f) a hollow, hyperboloid-shaped diffuser hood having an upper flange; said diffuser hood located below said float and surrounding said mixing blades;

(g) a plurality of generally vertically-oriented support rods connected to both said cone and said hood and slidably extending through said float; and (h) a diffuser drive mechanism operably connected to said diffuser cone, support rods and hood and operably moving said cone and said hood between a first, aeration position and a second, anoxic-mixing position; said diffuser drive mechanism maintaining said cone in spaced relation to said bore and also maintaining said hood upper flange abutting said bottom of said float when said cone and said hood are in said first position; said diffuser drive mechanism maintaining said cone seated in said bore so as to block flow of wastewater therethrough and also maintaining said hood in spaced relation to said bottom of said float when said cone and said hood are in said second position.

3. In a surface aerator for mixing oxygen with wastewater in a wastewater treatment facility having a float, a diffuser member and axial flow-mixer means for propelling wastewater upwardly through a flow channel in the float and onto the diffuser member; the improvement comprising:

(a) said diffuser member having a first position wherein said diffuser member is spaced from the flow channel and a second position wherein said diffuser member sealably seats in and blocks wastewater flow through said flow channel;

(b) diffuser drive means for operably moving said diffuser member between said first and second positions; and (c) a diffuser hood having a top surface; said hood being located in spaced relation to said diffuser member; said mixer means including a motor-driven mixer having radially-extending blades; said hood surrounding said blades of the mixer; said hood top surface abutting the float when said diffuser member is in said first position and said hood top surface being spaced from said float when said diffuser member is in said second position.

4. The aerator according to claim 3 wherein:

(a) said diffuser member is a diffuser cone.

5. An aeration and mixing apparatus for treatment of wastewater; said apparatus comprising:

(a) a float having a top, bottom and generally vertical bore extending therethrough;

(b) water-dispersing means mounted on said float; said water-dispersing means having a first position wherein said water-dispersing means is positioned to propel the wastewater upwardly through said bore and a second position wherein said water-dispersing means is adapted to block flow of wastewater through said bore and circulates the wastewater in a downward direction;

(c) a mixer mounted on said float; said mixer having a mixing stem and mixing blades;

(d) a mixer motor mounted on the top of said float operably connected to said mixer;

(e) a diffuser cone slidingly mounted on said mixing stem and located generally above said bottom of said float;

(f) a diffuser hood having an upper portion and an upper edge; said hood being connected to said diffuser cone and located in spaced relation thereto; said diffuser hood surrounding said mixing blades; and (g) a diffuser drive mechanism operably connected to said diffuser cone and adapted to transfer said cone and hood between a first, aeration position and a second, anoxic-mixing position thereof.

6. The apparatus according to claim 5 wherein:

(a) said hood is hyperboloid in shape.

7. The apparatus according to claim 5 wherein:

(a) said cone is maintained in spaced relation to said bore and said upper edge of said hood abuts said float when said cone and said hood are in said first position; and (b) said cone is seated in said bore so as to block flow of wastewater therethrough and said hood is located in spaced relation to the bottom of said float when said cone and said hood are in said second position.

* * * * *